US009875711B2

(12) United States Patent
Fang et al.

(10) Patent No.: US 9,875,711 B2
(45) Date of Patent: Jan. 23, 2018

(54) GATE DRIVER OF DISPLAY PANEL AND OPERATION METHOD THEREOF

(71) Applicant: Novatek Microelectronics Corp., Hsinchu (TW)

(72) Inventors: Po-Hsiang Fang, Hsinchu (TW); Jhih-Siou Cheng, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 93 days.

(21) Appl. No.: 15/016,295

(22) Filed: Feb. 5, 2016

(65) Prior Publication Data

US 2017/0229085 A1 Aug. 10, 2017

(51) Int. Cl.
*G09G 3/36* (2006.01)

(52) U.S. Cl.
CPC ... *G09G 3/3677* (2013.01); *G09G 2310/0251* (2013.01); *G09G 2310/08* (2013.01)

(58) Field of Classification Search
CPC ..... G09G 3/3677; G09G 2310/08; G09G 2310/0251
See application file for complete search history.

(56) References Cited

U.S. PATENT DOCUMENTS

| | | | | |
|---|---|---|---|---|
| 9,379,697 | B2 * | 6/2016 | Hsu | H03K 17/162 |
| 2008/0136809 | A1 * | 6/2008 | Lee | G09G 3/3677 345/214 |
| 2011/0221729 | A1 | 9/2011 | Chuang et al. | |
| 2016/0253975 | A1 * | 9/2016 | Yang | G11C 19/28 345/58 |

FOREIGN PATENT DOCUMENTS

| | | |
|---|---|---|
| CN | 102622983 | 8/2012 |
| CN | 103985339 | 8/2014 |
| TW | I427591 | 2/2014 |
| TW | I451378 | 9/2014 |
| TW | I498877 | 9/2015 |
| TW | I512740 | 12/2015 |

OTHER PUBLICATIONS

"Notice of allowance of Taiwan Counterpart Application", dated Sep. 19, 2016, p. 1-p. 5.

* cited by examiner

*Primary Examiner* — Andrew Sasinowski
(74) *Attorney, Agent, or Firm* — JCIPRNET

(57) ABSTRACT

A gate driver and an operation method thereof are provided. The gate driver includes clock transmission wires and driving circuits. The clock transmission wires are configured to transmit clock signals having different phases. Each of the driving circuits has a clock input terminal, a pre-charge terminal, a discharge control terminal and an output terminal. The output terminals are configured to drive gate lines of a display panel. The driving circuits are grouped into several driving circuit groups. The driving circuits belonging to a first driving circuit group among the driving circuit groups are called first driving circuits. The clock input terminals of the first driving circuits are coupled to different transmission wires among the clock transmission wires. The pre-charge terminals of the first driving circuits commonly receive a first pre-charge signal. The discharge control terminals of the first driving circuits commonly receive a first discharge control signal.

16 Claims, 7 Drawing Sheets

GATE DRIVER OF DISPLAY PANEL AND OPERATION METHOD THEREOF

BACKGROUND

Field of the Invention

The invention is directed to a display apparatus and more particularly, to a gate driver of a display panel and an operation method thereof.

Description of Related Art

In order to achieve cost saving for currently available crystal display panel produces, a gate driver is commonly manufactured using an amorphous silicon transistor. When a display panel is designed, a gate driver circuit is directly manufactured in a thin film transistor array (TFT Array) of the display panel, which is called a gate on panel (GOP) circuit or a gate on array (GOA) circuit in this industry. This method can effective achieve reduction in pin counts of driver chips. The GOP circuit has been a well know technique; however, corresponding scan lines (or gate lines) in the current GOP circuit structure are turned on/driven according to a fixed order, without any variability.

SUMMARY

The invention provides a gate driver of a display panel and an operation method thereof capable of providing variability of a scanning order.

According to an embodiment of the invention, a gate driver is provided. The gate driver includes a plurality of clock transmission wires and a plurality of driving circuits. The clock transmission wires are configured to transmit a plurality of clock signals having different phases. Each of the driving circuits has a clock input terminal, a pre-charge terminal, a discharge control terminal and an output terminal. The output terminals are configured to drive a plurality of gate lines of a display panel. The driving circuits are grouped into a plurality of driving circuit groups. The driving circuits of a first driving circuit group among the driving circuit groups are called first driving circuits. The clock input terminals of the first driving circuits are coupled to different transmission wires among the clock transmission wires. The pre-charge terminals of the first driving circuits commonly receive a first pre-charge signal. The discharge control terminals of the first driving circuits commonly receive a first discharge control signal.

According to an embodiment of the invention, an operation method of a gate driver is provided. The operation method includes the following steps. A plurality of clock transmission wires are disposed for transmitting a plurality of clock signals having different phases. A plurality of driving circuits are disposed, wherein each of the driving circuits has a clock input terminal, a pre-charge terminal, a discharge control terminal and an output terminal, and the output terminals is configured to drive a plurality of gate lines of a display panel. The driving circuits are grouped into a plurality of driving circuit groups, wherein the driving circuits of a first driving circuit group among the driving circuit groups are called first driving circuits, and the clock input terminals of the first driving circuits are coupled to transmission wires among the clock transmission wires. A first pre-charge signal is commonly received by the pre-charge terminals of the first driving circuits. A first discharge control signal is commonly received by the discharge control terminals of the first driving circuits.

To sum up, in invention, the gate driver of the display panel and the operation method thereof can group the driving circuits into a plurality of driving circuit groups. The pre-charge terminals of the driving circuits belonging to the same driving circuit group commonly receive the same pre-charge signal, and the discharge control terminals of the driving circuits belonging to the same driving circuit group commonly receive the same discharge control signal. The gate driver of the display panel of the invention can provide the variability of the scanning order of the gate lines by changing a phase relationship among the clock signals of the plurality of clock transmission wires.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
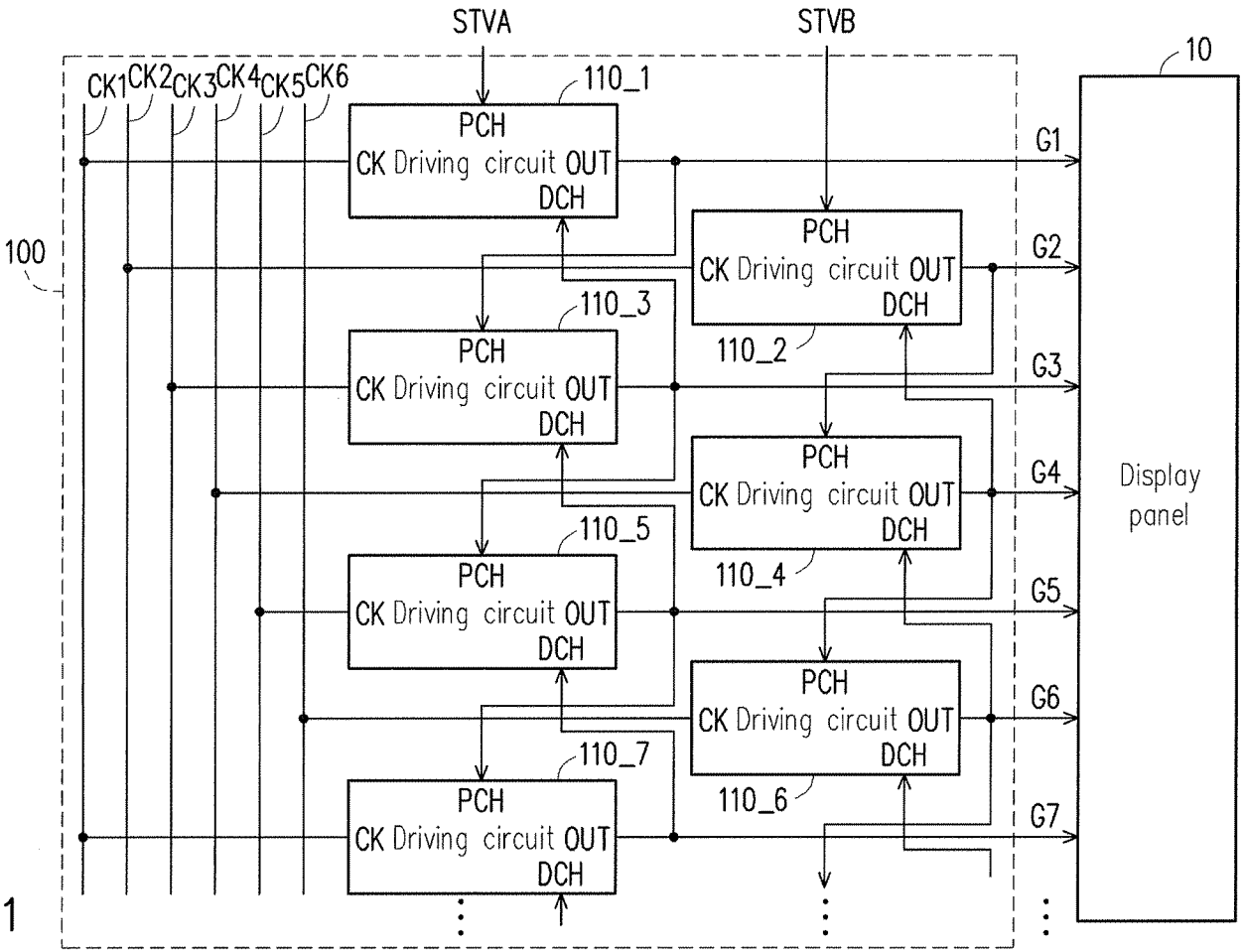
FIG. 1 is a schematic circuit block diagram of an implementation example of a gate driver.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

When a display panel is designed, a gate driver circuit directly manufactured in a thin film transistor array (TFT array) is called a gate on panel (GOP) circuit or a gate on array (GOA) circuit. FIG. 1 is a schematic circuit block diagram of an implementation example of a gate driver 100. The gate driver 100 includes a plurality of clock transmission wires (e.g., clock transmission wires $CK_1$, $CK_2$, $CK_3$, $CK_4$, $CK_5$ and $CK_6$ illustrated in FIG. 1) and a plurality of driving circuits (e.g., driving circuits 110_1, 110_2, 110_3, 110_4, 110_5, 110_6 and 110_7 illustrated in FIG. 1). Each of the driving circuits 110_1 to 110_7 has a clock input terminal CK, a pre-charge terminal PCH, a discharge control terminal DCH and an output terminal OUT. The output terminals OUT of the driving circuits 110_1 to 110_7 are configured to drive a plurality of gate lines (e.g., gate lines G1, G2, G3, G4, G5, G6 and G7 illustrated in FIG. 1) of the display panel 10.

Each of the pre-charge terminals PCH of the driving circuits 110_1 to 110_7 receives a driving signal of the output terminal OUT of a previous-stage driving circuit and serves it as a pre-charge signal. For example, the pre-charge terminal PCH of the driving circuit 110_7 receives a driving signal of the output terminal OUT of the driving circuit 110_5, the pre-charge terminal PCH of the driving circuit 110_6 receives a driving signal of the output terminal OUT of the driving circuit 110_4, and the pre-charge terminal PCH of the driving circuit 110_5 receives a driving signal of the output terminal OUT of the driving circuit 110_3. The pre-charge terminal PCH of the driving circuit 110_1 receives a first start pulse STVA, and the pre-charge terminal PCH of the driving circuit 110_2 receives a second start pulse STVB.

Each of the discharge control terminals DCH of the driving circuits 110_1 to 110_7 receives the driving signal of the output terminal OUT of a next stage driving circuit and serves it as a discharge control signal. For example, the discharge control terminal DCH of the driving circuit 110_1 receives the driving signal of the output terminal OUT of the driving circuit 110_3, the discharge control terminal DCH of the driving circuit 110_2 receives the driving signal of the output terminal OUT of the driving circuit 110_4, and the discharge control terminal DCH of the driving circuit 110_3 receives the driving signal of the output terminal OUT of the driving circuit 110_5.

Figure 2:
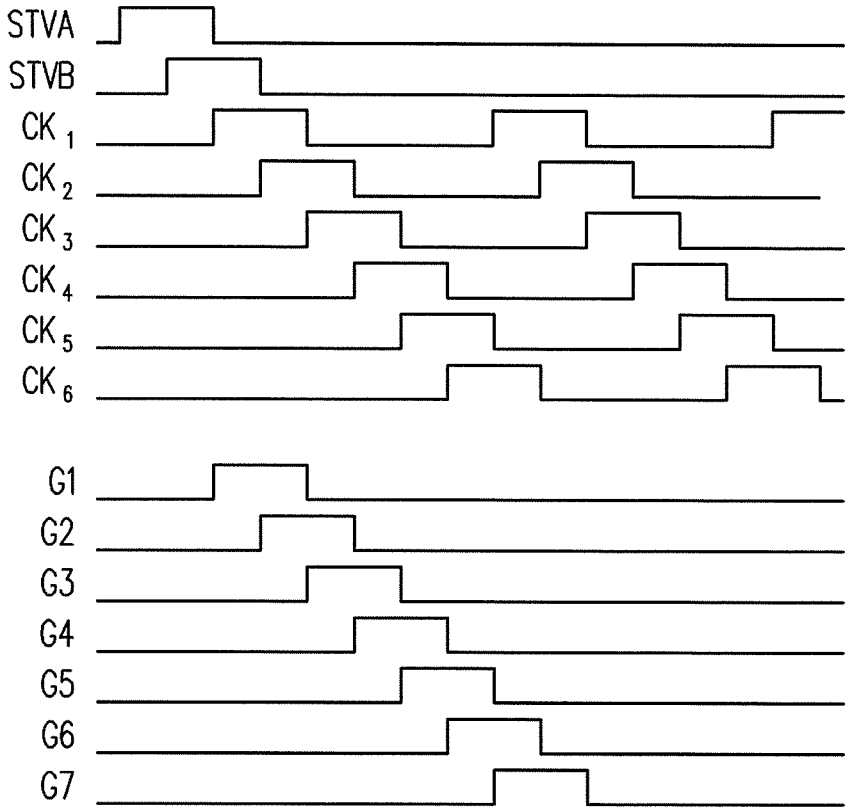
FIG. 2 is a schematic signal timing diagram of the circuit depicted in FIG. 1.

FIG. 2 is a schematic signal timing diagram of the circuit depicted in FIG. 1. Referring to FIG. 2, the horizontal axis represents the time. Referring to FIG. 1 and FIG. 2, the clock transmission wires $CK_1$ to $CK_6$ transmits a plurality of clock signals having different phases. The clock input terminals CK of the driving circuits 110_1 to 110_7 are respectively coupled to different transmission wires among the clock transmission wires $CK_1$ to $CK_6$. For example, the clock input terminal CK of the driving circuit 110_1 is coupled to the clock transmission wire $CK_1$, the clock input terminal CK of the driving circuit 110_2 is coupled to the clock transmission wire $CK_2$, the clock input terminal CK of the driving circuit 110_3 is coupled to the clock transmission wire $CK_3$, the clock input terminal CK of the driving circuit 110_4 is coupled to the clock transmission wire $CK_4$, the clock input terminal CK of the driving circuit 110_5 is coupled to the clock transmission wire $CK_5$, the clock input terminal CK of the driving circuit 110_6 is coupled to the clock transmission wire $CK_6$, and the clock input terminal CK of the driving circuit 110_7 is coupled to the clock transmission wire $CK_1$. If an Nth gate line is to be turned on, a pre-charge operation of an Nth driving circuit is controlled by a signal of an (N−X) gate line (where X is a fixed value), and a discharge operation of the Nth driving circuit is controlled by an (N+Y) gate line (where Y is a fixed value). For example, if the gate line G3 is to be turned on, the pre-charge operation of the driving circuit 110_3 is controlled by a signal of the gate line G1, and a discharge operation of the driving circuit 110_3 is controlled by a signal of the gate line G5. Based on a triggering timing sequence of the clock signals of the clock transmission wires $CK_1$ to $CK_6$, the driving circuits 110_1, 110_3, 110_5 and 110_7 take turns to transmit the first start pulse STVA in the gate lines G1, G3, G5 and G7, and the driving circuits 110_2, 110_4 and 110_6 take turns to transmit the second start pulse STVB in the gate lines G2, G4 and G6, as shown in FIG. 2. In any way, a driving order (or a scanning order) of the gate driver 100 driving the gate lines G1 to G7 illustrated in FIG. 1 is fixed, as shown in FIG. 2.

Figure 3:
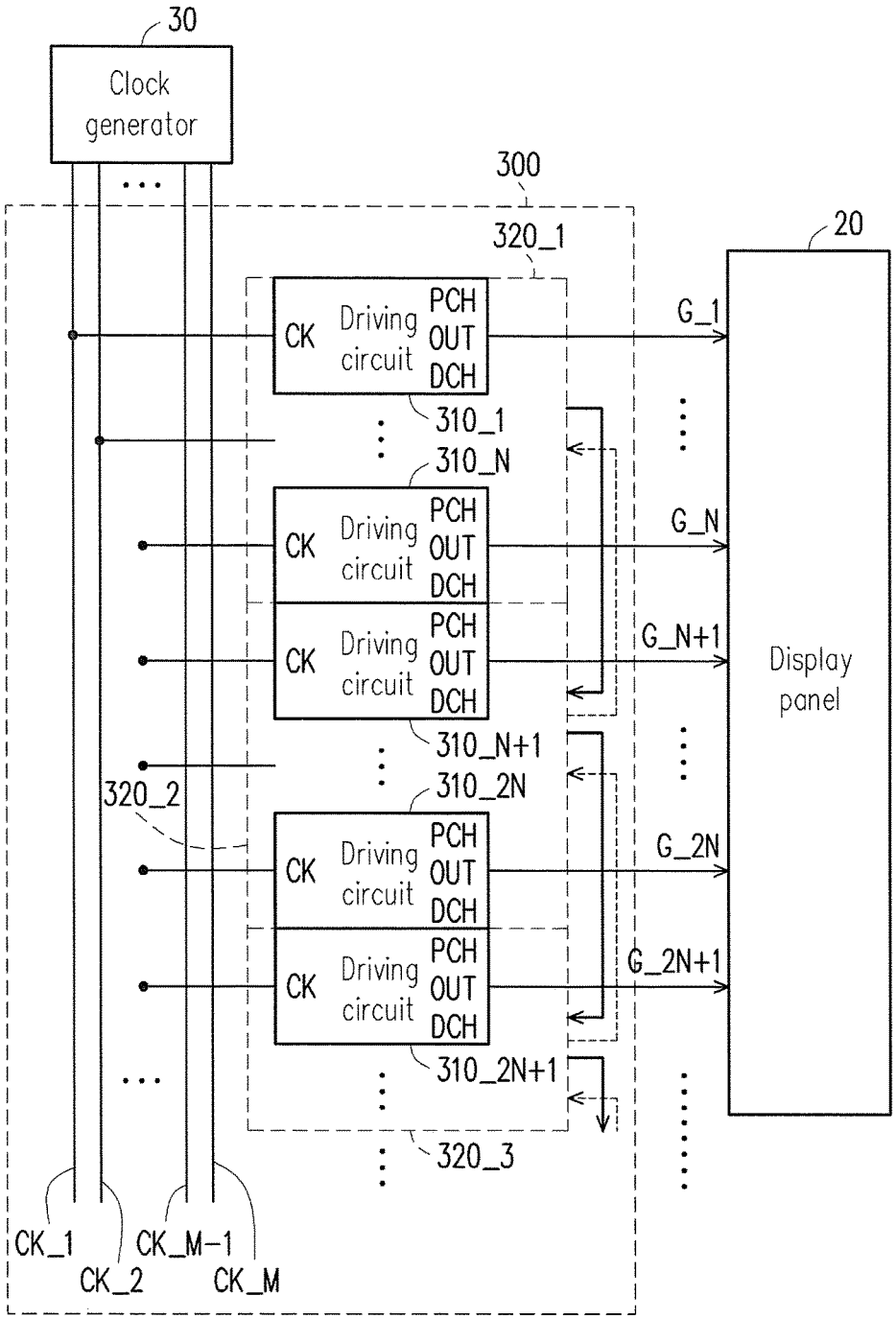
FIG. 3 is a schematic circuit block diagram of a gate driver according to an embodiment of the invention.

FIG. 3 is a schematic circuit block diagram of a gate driver 300 according to an embodiment of the invention. The gate driver 300 includes a plurality of clock transmission wires (e.g., clock transmission wires CK_1, CK_2, . . . , CK_M−1 and CK_M illustrated in FIG. 3, where M is an integer) and a plurality of driving circuits (e.g., driving circuits 310_1, . . . , 310_N, 310 N+1, . . . , 310_2N, 310_2N+1 and so forth illustrated in FIG. 3, where N is an integer). Therein, a quantity N of the driving circuits in a driving circuit group is less than or equal to a quantity M of the clock transmission wires CK__1 to CK_M. In the present embodiment, the driving circuits 310_1 to 310_2N+1 are gate on panel (GOP) circuits. Each of the driving circuits 310_1 to 310_2N+1 has a clock input terminal CK, a pre-charge terminal PCH, a discharge control terminal DCH and an output terminal OUT. The output terminals OUT of the driving circuits 310_1 to 310_2N+1 are configured to drive a plurality of gate lines (e.g., gate lines G_1, . . . , G_N, G_N+1, . . . , G_2N, G_2N+1 and so forth illustrated in FIG. 3) of a display panel 20, as shown in FIG. 3.

The driving circuits 310_1 to 310_2N+1 are grouped into a plurality of driving circuit groups (e.g., driving circuit groups 320_1, 320_2 and 320_3 illustrated in FIG. 3). The pre-charge terminals PCH of the driving circuits belonging to the same driving circuit group commonly receive the same pre-charge signal, and the discharge control terminals DCH of the driving circuits belonging to the same driving circuit group commonly receive the same discharge control signal. For example (but not limited to), the pre-charge terminals PCH of the driving circuits 310_N+1 to 310_2N belonging to the driving circuit group 320_2 commonly receive the driving signal of the output terminal OUT of one of the driving circuits belonging to the driving circuit group 320_1 to serve it as the pre-charge signal, and discharge control terminals DCH of the driving circuits 310 N+1 to 310_2N belonging to the driving circuit group 320_2 commonly receive the driving signal of the output terminal OUT of one of the driving circuits belonging to the driving circuit group 320_3 to serve it as the discharge control signal. In the same way, the discharge control terminals DCH of the driving circuits 310_1 to 310_N belonging to the driving circuit group 320_1 commonly receive the driving signal of the output terminal OUT of one of the driving circuits belonging to the driving circuit group 320_2 to serve it as the discharge control signal, and pre-charge terminals PCH of the driving circuits belonging to the driving circuit group 320_3 commonly receive the driving signal of the output terminal OUT of one of the driving circuits belonging to the driving circuit group 320_2 to serve it as the pre-charge signal.

A plurality of clock transmission wires (e.g., clock transmission wires CK_1, CK_2, . . . , CK_M−1 and CK_M illustrated in FIG. 3) are coupled to the clock generator 30 to transmit a plurality of clock signals having different phases. The clock input terminals CK of the driving circuits belonging to the same driving circuit group (e.g., the driving circuits 310_1 to 310_N belonging to the driving circuit group 320_1) are coupled to different transmission wires among the clock transmission wires CK_1 to CK_M. In the same driving circuit group, the clock signals of the clock transmission wires $CK_1$ to $CK_6$ may be employed to determine a driving order (or a scanning order) of the driving circuits.

Figure 4:
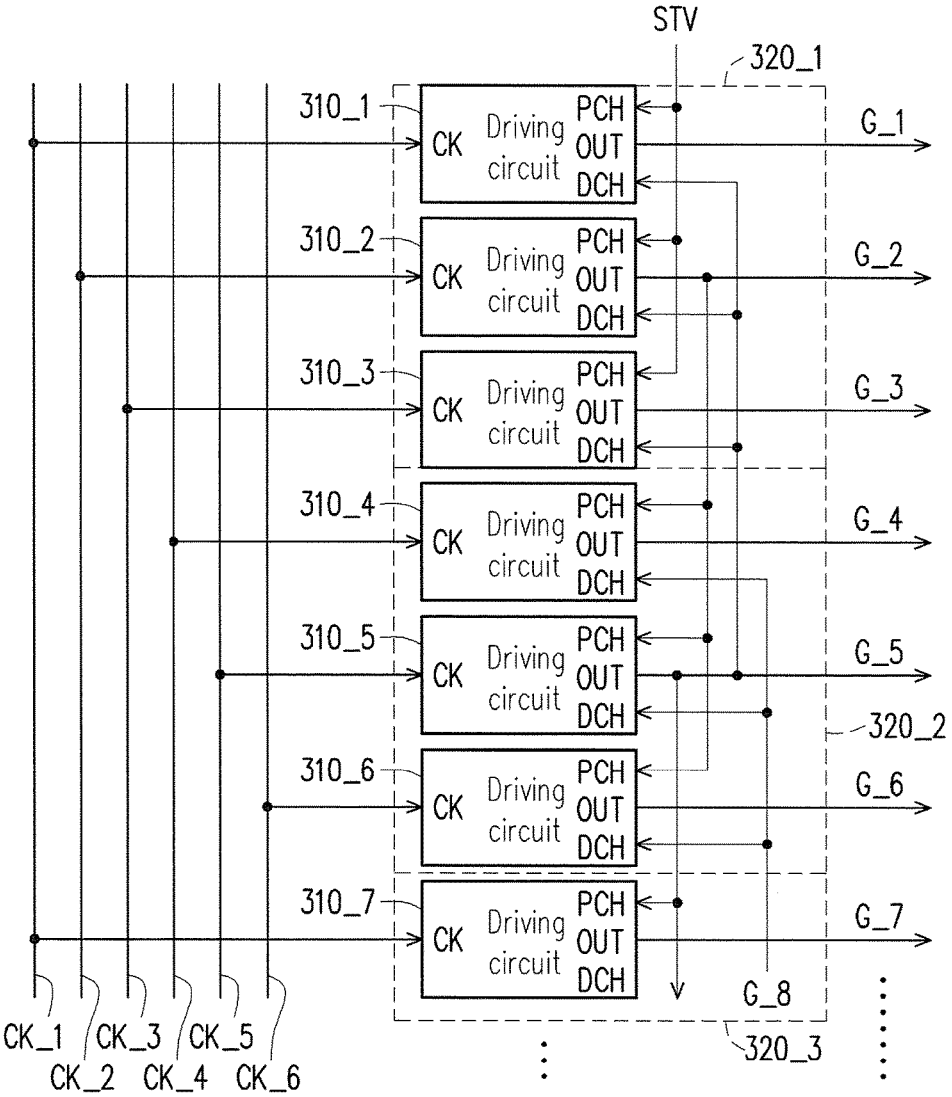
FIG. 4 is a schematic circuit block diagram of the gate driver depicted in FIG. 3 according to an embodiment of the invention.

FIG. 4 is a schematic circuit block diagram of the gate driver 300 depicted in FIG. 3 according to an embodiment of the invention. It is assumed in the embodiment illustrated in FIG. 4 that the gate driver 300 has 6 clock transmission wires, which are clock transmission wires CK_1, CK_2, CK_3, CK_4, CK_5 and CK_6 as shown in FIG. 4. It is further assumed in the embodiment illustrated in FIG. 4 that each of the driving circuit groups has 3 driving circuits. For example, referring to FIG. 4, the driving circuit group 320_1 has the driving circuits 310_1, 310_2 and 310_3, and the driving circuit group 320_2 has the driving circuits 310_4, 310_5 and 310_6. The output terminals OUT of the driving circuits 310_1 to 310_7 are configured to drive the gate lines G_1, G_2, G_3, G_4, G_5, G_6 and G_7 of the display panel, as shown in FIG. 4.

The pre-charge terminals PCH of the driving circuits belonging to the same driving circuit groups commonly receive the same pre-charge signal, and the discharge control terminals DCH of the driving circuits belonging to the same driving circuit group commonly receive the same discharge control signal. For example, the pre-charge terminals PCH of the driving circuits 310_1, 310_2 and 310_3 belonging to the driving circuit group 320_1 commonly receive a start pulse STV to serve it as the pre-charge signal, and the discharge control terminals DCH of the driving circuits 310_1, 310_2 and 310_3 belonging to the driving circuit group 320_1 commonly receive the driving signal of the output terminal OUT of the driving circuit 310_5 belonging to the driving circuit group 320_2 (which is the signal of the gate line G_5) to serve it as the discharge control signal. In the same way, the pre-charge terminal PCH of the driving circuits 310_4, 310_5 and 310_6 belonging to the driving circuit group 320_2 commonly receive the driving signal (i.e., the signal of the gate line G_2) of the output terminal OUT of the driving circuit 310_2 belonging to the driving circuit group 320_1 to serve it as the pre-charge signal, and the discharge control terminal DCH of the driving circuits 310_4, 310_5 and 310_6 belonging to the driving circuit group 320_2 commonly receive the driving signal (i.e., the signal of the gate line G_8) of the output terminal OUT of one of the driving circuits belonging to the driving circuit group 320_3 to serve it as the discharge control signal. The pre-charge terminals PCH of the driving circuits (e.g., the driving circuit 310_7) belonging to the driving circuit group 320_3 commonly receive the driving signal (i.e., the signal of the gate line G_5) of the output terminal OUT of the driving circuit 310_5 belonging to the driving circuit group 320_2 to serve it as the pre-charge signal.

Figure 5:
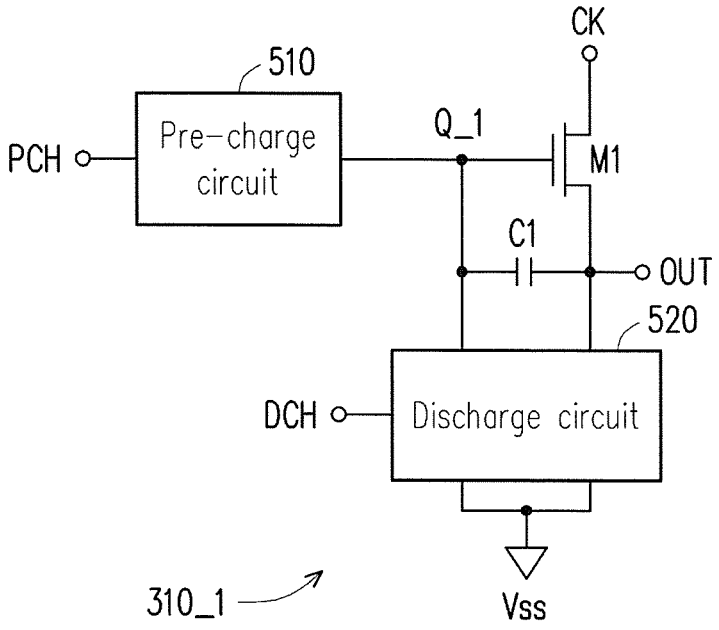
FIG. 5 is a schematic circuit block diagram of one of the driving circuits depicted in FIG. 4 according to an embodiment of the invention.

FIG. 5 is a schematic circuit block diagram of the driving circuit 310_1 depicted in FIG. 4 according to an embodiment of the invention. The other driving circuits (e.g., the driving circuits 310_2 to 310_7) illustrated in FIG. 4 may be deduced with reference to the description related to the driving circuit 310_1 and thus, will not be repeated. In the embodiment illustrated in FIG. 5, the driving circuit 310_1 includes a transistor M1, a capacitor C1, a pre-charge circuit 510 and a discharge circuit 520. The transistor M1 has a first terminal (e.g., a drain), a second terminal (e.g., a source) and a control terminal (e.g., a gate). The first terminal of the transistor M1 serves as the clock input terminal CK of the driving circuit 310_1 to be coupled to a corresponding clock transmission wire (e.g., clock transmission wire CK_1) among the clock transmission wires CK_1 to CK_6. The second terminal transistor M1 serves as the output terminal OUT of the driving circuit 310_1 to be coupled to a corresponding gate line (e.g., the gate line G_1) among the gate lines G_1 to G_7. The control terminal of the pre-charge circuit 510 serves as the pre-charge terminal PCH of the driving circuit 310_1 to receive the pre-charge signal. The pre-charge circuit 510 is controlled by the pre-charge signal of the pre-charge terminal PCH to determine whether to pre-charge the control terminal of the transistor M1. A first terminal of the capacitor C1 is coupled to the control terminal of the transistor M1. A second terminal of the capacitor C1 is coupled to the second terminal of the transistor M1. The discharge circuit 520 is coupled to the first terminal of the capacitor C1 and the second terminal of the capacitor C1. A control terminal of the discharge circuit 520 serves as the discharge control terminal DCH of the driving circuit 310_1 to receive the discharge control signal. The discharge circuit 520 is controlled by the discharge control signal of the discharge control terminal DCH to determine whether to discharge the capacitor C1 (i.e., release the charge of the capacitor C1 to a reference voltage source Vss).

Figure 6:
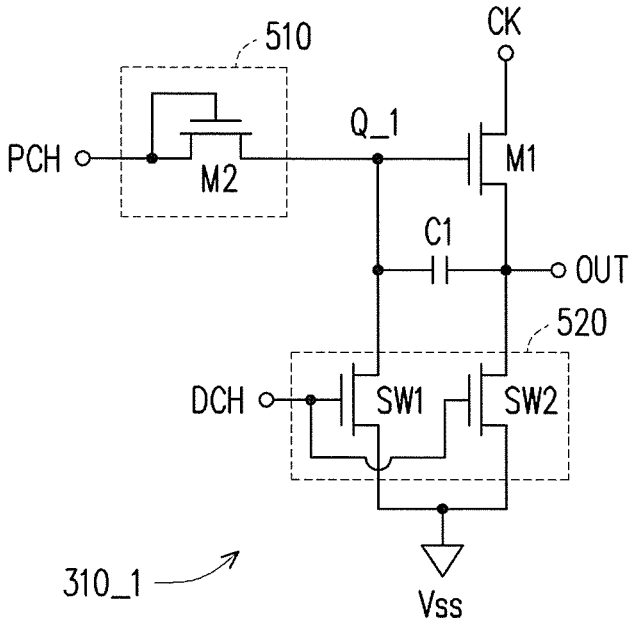
FIG. 6 is a schematic circuit diagram of the pre-charge circuit and the discharge circuit depicted in FIG. 5 according to an embodiment of the invention.

FIG. 6 is a schematic circuit diagram of the pre-charge circuit 510 and the discharge circuit 520 depicted in FIG. 5 according to an embodiment of the invention. Referring to FIG. 6, the pre-charge circuit 510 includes a transistor M2. A control terminal (e.g., a gate) and a first terminal (e.g., a drain) of the transistor M2 receive the pre-charge signal of the pre-charge terminal PCH. A second terminal of the transistor M2 (e.g., a source) is coupled to the control terminal of the transistor M1. In other embodiments, the transistor M2 may be replaced by a diode, an anode of the diode receives the pre-charge signal of the pre-charge terminal PCH, and a cathode of the diode is coupled to the control terminal of the transistor M1.

The discharge circuit illustrated in FIG. 6 receives a switch SW1 and a switch SW2. A first terminal of the switch SW1 is coupled to the first terminal of the capacitor C1. A second terminal of the switch SW1 is coupled to a reference voltage source Vss. A control terminal of the switch SW1 receives the discharge control signal of the discharge control terminal DCH. A first terminal of the switch SW2 is coupled to the second terminal of the capacitor C1. A second terminal of the switch SW2 is coupled to the reference voltage source Vss. A control terminal of the switch SW2 receives the discharge control signal of the discharge control terminal DCH.

Figure 7:
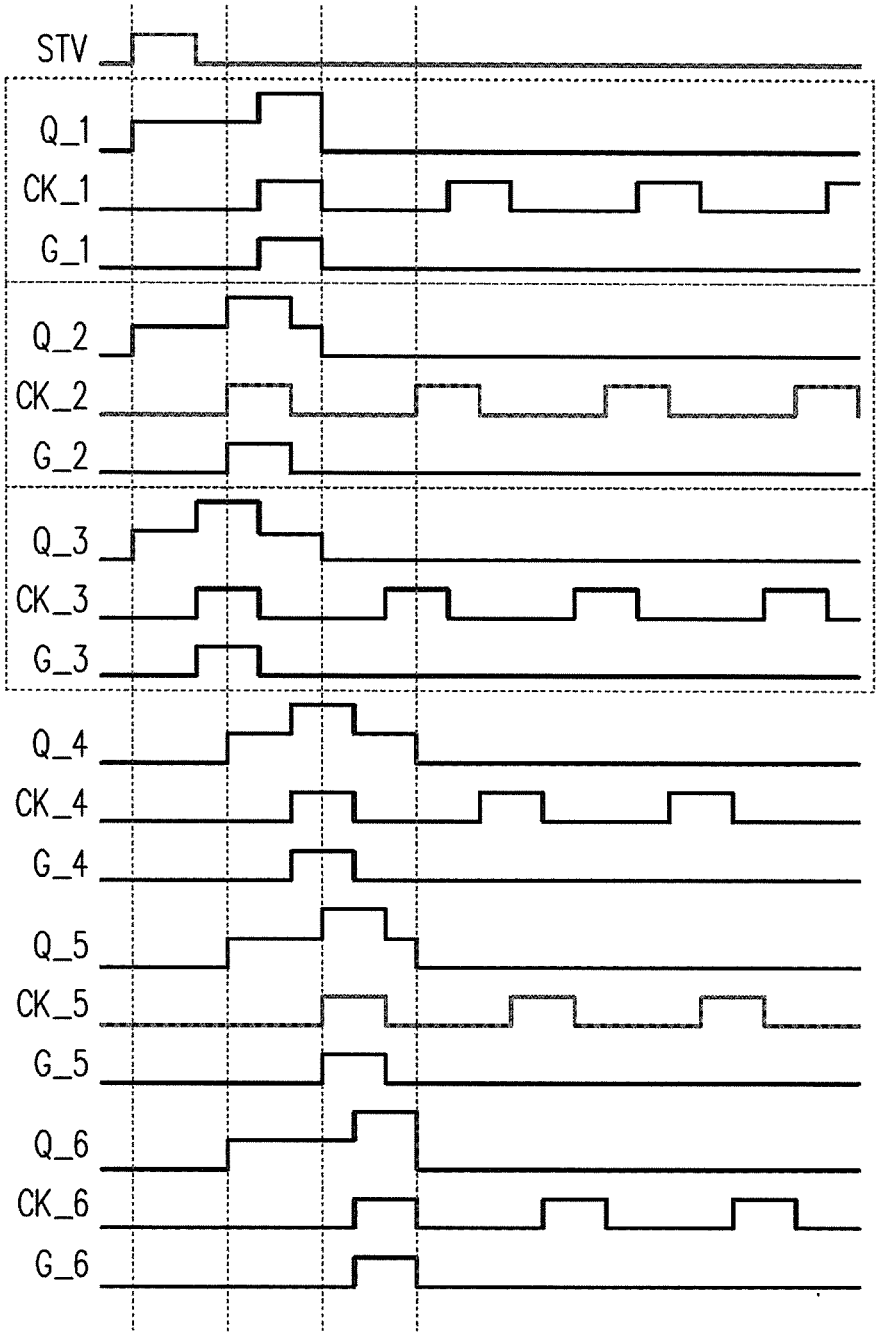
FIG. 7 is a schematic signal timing diagram of the circuits depicted in FIG. 4 and FIG. 5 according to an embodiment of the invention.

FIG. 7 is a schematic signal timing diagram of the circuits depicted in FIG. 4 and FIG. 5 according to an embodiment of the invention. Referring to FIG. 7, the horizontal axis represents the time. Referring to FIG. 4, FIG. 5 and FIG. 7, the pre-charge terminals PCH of the driving circuits 310_1, 310_2 and 310_3 belonging to the driving circuit group 320_1 commonly receive the start pulse STV to serve it as the pre-charge signal. Taking the driving circuit 310_1 as an example, when the start pulse STV has a logic high level, the pre-charge circuit 510 pre-charges the first terminal of the capacitor C1 and the control terminal of the transistor M1, such that a voltage of a node Q_1 (i.e., a voltage of the control terminal of the transistor M1) is pulled up. The transistor M1 is turned on by the high-level voltage of the node Q_1, such that the driving circuit 310_1 transmits the signal of the clock input terminal CK to the output terminals OUT. Namely, the signal of the clock transmission wire CK_1 may be transmitted to the gate line G_1. Taking the driving circuit 310_1 illustrated in FIG. 5 as an example to deduce the other driving circuits 310_2 and 310_3 by analogy, a voltage of a node Q_2 in the driving circuit 310_2

(which may be deduced by analogy according to the voltage of the node Q_1 illustrated in FIG. 5) and a voltage of a node Q_3 in the driving circuit 310_3 (which may be deduced by analogy according to the voltage of the node Q_1 illustrated in FIG. 5) are also pulled up, as shown in FIG. 7. The high-level voltages of the nodes Q_2 and Q_3 induce the driving circuits 310_2 and 310_3 to transmit the signals of the clock input terminal CK to the output terminals OUT. In other words, the signal of the clock transmission wire CK_2 is transmitted to the gate line G_2, and the signal of the clock transmission wire CK_3 is transmitted to the gate line G_3. By changing a phase relationship among the clock signals of the clock transmission wires CK_1 to CK_3, the gate driver 300 of the present embodiment may provide variability of a scanning order of the gate lines G_1 to G_3.

The pre-charge terminals PCH of the driving circuits 310_4, 310_5 and 310_6 belonging to the driving circuit group 320_2 commonly receive the driving signal (i.e., the signal of the gate line G_2) of the output terminal OUT of the driving circuit 310_2 belonging to the driving circuit group 320_1 to serve it as the pre-charge signal. Taking the driving circuit 310_1 illustrated in FIG. 5 as an example to deduce the other driving circuits 310_4, 310_5 and 310_6, when the signal of the gate line G_2 has a logic high level, a voltage of a node Q_4 in the driving circuit 310_4 (which may be deduced by analogy according to the voltage of the node Q_1 illustrated in FIG. 5), a voltage of a node Q_5 in the driving circuit 310_5 (which may be deduced by analogy according to the voltage of the node Q_1 illustrated in FIG. 5) and a voltage of a node Q_6 in the driving circuit 310_6 (which may be deduced by analogy according to the voltage of the node Q_1 illustrated in FIG. 5) are also pulled up, as shown in FIG. 7. High-level voltages of the nodes Q_4, Q_5 and Q_6 induce the driving circuits 310_4, 310_5 and 310_6 to transmit the signals of the clock input terminals CK to the output terminals OUT. In other words, the signal of the clock transmission wire CK_4 is transmitted to the gate line G_4, the signal of the clock transmission wire CK_5 is transmitted to the gate line G_5, and the signal of the clock transmission wire CK_6 is transmitted to the gate line G_6. By changing a phase relationship among the clock signals of the clock transmission wires CK_4 to CK_6, the gate driver 300 of the present embodiment may provide variability of a scanning order of the gate lines G_4 to G_6.

The discharge control terminals DCH of the driving circuits 310_1, 310_2 and 310_3 belonging to the driving circuit group 320_1 commonly receive the driving signal (i.e., the signal of the gate line G_5) of the output terminal OUT of the driving circuit 310_5 belonging to the driving circuit group 320_2 to serve it as the discharge control signal. Taking the driving circuit 310_1 as an example, when the signal of the gate line G_5 has a logic high level, the voltage of the node Q_1 (i.e., the voltage of the control terminal of the transistor M1) is pulled down by the discharge circuit 520. The transistor M1 is turned off by the low-level voltage of the node Q_1, such that the voltage of the output terminal OUT of the driving circuit 310_1 is maintained at a low level, that is, the signal of the clock transmission wire CK_1 is not transmitted to the gate line G_1. Taking the driving circuit 310_1 illustrated in FIG. 5 as an example to deduce the other driving circuits 310_2 and 310_3 by analogy, when the signal of the gate line G_5 has a logic high level, the voltage of the node Q_2 in the driving circuit 310_2 and the voltage of the node Q_3 in the driving circuit 310_3 are also pulled down, as shown in FIG. 7. The low-level voltages of the nodes Q_2 and Q_3 induce the driving circuits 310_2 and 310_3 to maintain the voltages of the output terminal OUT at a low level, that is, the signal of the clock transmission wire CK_2 is not transmitted to the gate line G_2, and the signal of the clock transmission wire CK_3 is not transmitted to the gate line G_3.

The discharge control terminals DCH of the driving circuits 310_4, 310_5 and 310_6 belonging to the driving circuit group 320_2 commonly receive the driving signal (e.g., the signal of the gate line G_8) of the output terminal OUT of one of the driving circuits belonging to the driving circuit group 320_3 to serve it as the discharge control signal. Taking the driving circuit 310_1 illustrated in FIG. 5 as an example to deduce the driving circuits 310_4, 310_5 and 310_6 by analogy, when the signal of the gate line G_8 has a logic high level, the voltage of the node Q_4 in the driving circuit 310_4, the voltage of the node Q_5 in the driving circuit 10_5 and the voltage of the node Q_6 in the driving circuit 310_6 are also pulled down, as shown in FIG. 7. The low-level voltages of the nodes Q_4, Q_5 and Q_6 induce the driving circuits 310_4, 310_5 and 310_6 to maintain the voltages of the output terminals OUT at a low level, that is, the signal of the clock transmission wire CK_4 is not transmitted to the gate line G_4, the signal of the clock transmission wire CK_5 is not transmitted to the gate line G_5, and the signal of the clock transmission wire CK_6 is not transmitted to the gate line G_6.

Figure 8:
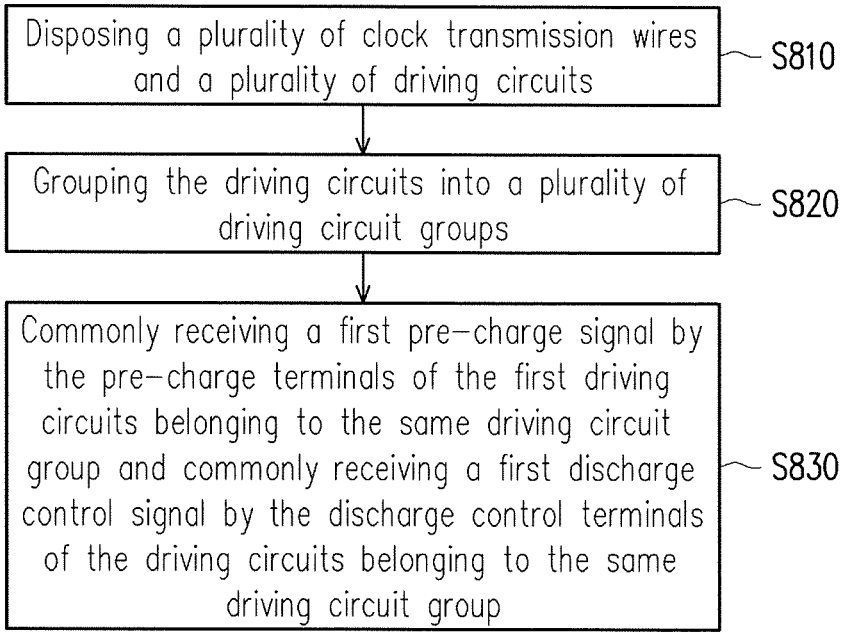
FIG. 8 is a flowchart of an operation method of a gate driver according to an embodiment of the invention.

FIG. 8 is a flowchart of an operation method of a gate driver according to an embodiment of the invention. In step S810, a plurality of clock transmission wires are disposed in a gate driver. A plurality of clock signals having different phases are transmitted by the clock transmission wires. A plurality of driving circuits are further disposed in the gate driver in step S810. Each of the driving circuits has a clock input terminal CK, a pre-charge terminal PCH, a discharge control terminal DCH and an output terminals OUT. The output terminals OUT of the driving circuits are configured to drive a plurality of gate lines of a display panel. In step S820, the driving circuits are grouped into a plurality of driving circuit groups. The driving circuits belonging to a first driving circuit group among the driving circuit groups are called as first driving circuits, and the clock input terminals CK of the first driving circuits are coupled to different transmission wires. In step S820, a pre-charge signal is commonly received by the pre-charge terminals PCH of the driving circuits belonging to the same driving circuit group, and a discharge control signal is commonly received by the discharge control terminals DCH of the driving circuits belonging to the same driving circuit group. For example, a first pre-charge signal is commonly received by the pre-charge terminals PCH of the first driving circuits of the first driving circuit group, and a first discharge control signal is commonly received by the discharge control terminals DCH of the first driving circuits belonging to the first driving circuit group.

It should be noted that in different application scenarios, related functions of the gate driver and/or the driving circuits can be implemented as firmware or hardware by using general hardware description languages (e.g., Verilog HDL or VHDL) or other suitable programming languages. The firmware capable of executing the aforementioned related functions can be implemented in any known computer-accessible media such as magnetic tapes, semiconductor memories, magnetic disks or compact disks (e.g., CD-ROM or DVD-ROM), or the firmware can be transmitted through the Internet, wired communication, wireless communication or other communication media. The firmware can be stored in the computer-accessible media to facilitate a processor of a computer to access/execute programming codes of the firmware. Moreover, the apparatus and the method of the invention can be implemented through a combination of hardware and software.

To summarize, the gate driver of the display panel and the operation method thereof provided by the embodiments of the invention can achieve grouping the driving circuits into a plurality of driving circuit groups, where the pre-charge terminals of the driving circuits belonging to the same driving circuit group commonly receive the same pre-charge signal, and the discharge control terminals of the driving circuits belonging to the same driving circuit group commonly receive the same discharge control signal. By changing the phase relationship among the clock signals of the plurality of clock transmission wires, the gate driver of the display panel of the invention can provide the variability of the scanning order of the gate lines.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A gate driver comprising:

a plurality of clock transmission wires, configured to transmit a plurality of clock signals having different phases; and a plurality of driving circuits, wherein each of the driving circuits has a clock input terminal, a pre-charge terminal, a discharge control terminal and an output terminal, the plurality of output terminals are configured to drive a plurality of gate lines of a display panel, the plurality of driving circuits are grouped into a plurality of driving circuit groups, the plurality of driving circuits belonging to a first driving circuit group among the plurality of driving circuit groups are called a plurality of first driving circuits, the plurality of clock input terminals of the plurality of first driving circuits are coupled to different transmission wires among the plurality of clock transmission wires, the plurality of pre-charge terminals of the plurality of first driving circuits commonly receive a same first pre-charge signal, and the plurality of discharge control terminals of the plurality of first driving circuits commonly receive a same first discharge control signal.

2. The gate driver as recited in claim 1, wherein a quantity of the plurality of first driving circuits in the first driving circuit group is less than or equal to a quantity of the clock transmission wires.

3. The gate driver as recited in claim 1, wherein each of the plurality of first driving circuits comprises:

a transistor, having a first terminal, a second terminal and a control terminal, wherein the first terminal of the transistor is coupled to a corresponding one of the clock transmission wires, and the second terminal of the transistor is configured to be coupled to a corresponding one of the gate lines;

a pre-charge circuit, controlled by the same first pre-charge signal so as to determine whether to pre-charge the control terminal of the transistor;

a capacitor, having a first terminal and a second terminal, wherein the first terminal of the capacitor is coupled to the control terminal of the transistor, the second terminal of the capacitor is coupled to the second terminal of the transistor; and a discharge circuit, coupled to the first terminal of the capacitor and the second terminal of the capacitor, wherein the discharge circuit is controlled by the same first discharge control signal so as to determine whether to discharge the capacitor.

4. The gate driver as recited in claim 3, wherein the pre-charge circuit comprises:

a diode, having an anode receiving the same first pre-charge signal, and a cathode coupled to the control terminal of the transistor.

5. The gate driver as recited in claim 3, wherein the pre-charge circuit comprises:

a second transistor, having a control terminal and a first tenninal receiving the same first pre-charge signal, and a second terminal coupled to the control terminal of the transistor.

6. The gate driver as recited in claim 3, wherein the discharge circuit comprises:

a first switch, having a first terminal coupled to the first terminal of the capacitor, a second terminal coupled to a reference voltage, and a control terminal receiving the same first discharge control signal; and a second switch, having a first terminal coupled to the second terminal of the capacitor, a second terminal coupled to the reference voltage, and a control terminal receiving the same first discharge control signal.

7. The gate driver as recited in claim 1, wherein the plurality of driving circuits belonging to a second driving circuit group among the plurality of driving circuit groups are called a plurality of second driving circuits, and a same driving signal of the output terminal of one of the plurality of second driving circuits is transmitted to the plurality of pre-charge terminals of the plurality of first driving circuits to serve as the same first pre-charge signal.

8. The gate driver as recited in claim 1, wherein the plurality of driving circuits belonging to a third driving circuit group among the plurality of driving circuit groups are called a plurality of third driving circuits, and a same driving signal of the output terminal of one of the plurality of third driving circuits is transmitted to the plurality of discharge control terminals of the plurality of first driving circuits to serve as the same first discharge control signal.

9. The gate driver as recited in claim 8, wherein the driving signal of the output terminal of one of the plurality of first driving circuits is transmitted to the plurality of pre-charge terminals of the plurality of third driving circuits to serve as a second pre-charge signal.

10. The gate driver as recited in claim 1, wherein the driving circuits are gate-on-panel (GOP) circuits.

11. An operation method of a gate driver, comprising:

disposing a plurality of clock transmission wires for transmitting a plurality of clock signals having different phases;

disposing a plurality of driving circuits, wherein each of the plurality of driving circuits has a clock input terminal, a pre-charge terminal, a discharge control terminal and an output terminal, and the plurality of output terminals are configured to drive a plurality of gate lines of a display panel;

grouping the plurality of driving circuits into a plurality of driving circuit groups, wherein the plurality of driving circuits belonging to a first driving circuit group among the plurality of driving circuit groups are called a plurality of first driving circuits, and the plurality of clock input terminals of the plurality of first driving circuits are coupled to different transmission wires among the plurality of clock transmission wires;

commonly receiving a same first pre-charge signal by the plurality of pre-charge terminals of the plurality of first driving circuits; and commonly receiving a same first discharge control signal by the plurality of discharge control terminals of the plurality of first driving circuits.

12. The operation method of the gate driver as recited in claim 11, wherein a quantity of the plurality of first driving circuits in the first driving circuit group is less than or equal to a quantity of the plurality of clock transmission wires.

13. The operation method of the gate driver as recited in claim 11, wherein the plurality of driving circuits belonging to a second driving circuit group among the plurality of driving circuit groups are called a plurality of second driving circuits, and a driving signal of the output tei iinal of one of the plurality of second driving circuits is transmitted to the plurality of pre-charge terminals of the plurality of first driving circuits to serve as the same first pre-charge signal.

14. The operation method of the gate driver as recited in claim 11, wherein the plurality of driving circuits belonging to a third driving circuit group among the plurality of driving circuit groups are called a plurality of third driving circuits, and a driving signal of the output terminal of one of the plurality of third driving circuits is transmitted to the plurality of discharge control terminals of the plurality of first driving circuits to serve as the same first discharge control signal.

15. The operation method of the gate driver as recited in claim 14, further comprising:

transmitting a driving signal of the output terminal of one of the plurality of first driving circuits to the plurality of pre-charge terminals of the plurality of third driving circuits to serve as a second pre-charge signal.

16. The operation method of the gate driver as recited in claim 11, wherein the driving circuits are gate-on-panel (GOP) circuits.

* * * * *